United States Patent [19]

Douty et al.

[11] 4,405,189

[45] Sep. 20, 1983

[54] NARROW PROFILE POWER DISTRIBUTION BLOCK

[75] Inventors: George H. Douty, Mifflintown; Leon T. Ritchie, Mechanicsburg; Clair W. Snyder, Jr., York, all of Pa.

[73] Assignee: AMP Incorporated, Harrisburg, Pa.

[21] Appl. No.: 292,565

[22] Filed: Aug. 13, 1981

[51] Int. Cl.[3] ..... H01R 23/68

[52] U.S. Cl. ..... 339/17 C; 339/95 R

[58] Field of Search ..... 339/17 C, 17 LC, 95 R

[56] References Cited

U.S. PATENT DOCUMENTS

| | | | |
|---|---|---|---|
| 3,363,224 | 1/1968 | Gluntz . | |
| 4,243,288 | 1/1981 | Lucius et al. | 339/99 R |
| 4,264,114 | 4/1981 | Chandler | 339/17 LC |
| 4,338,717 | 7/1982 | Damon | 339/17 LC |

FOREIGN PATENT DOCUMENTS

| | | | |
|---|---|---|---|
| 2412224 | 7/1979 | France | 339/17 LC |
| 2026790 | 2/1980 | United Kingdom | 339/17 LC |

*Primary Examiner*—Howard N. Goldberg
*Attorney, Agent, or Firm*—Russell J. Egan

[57] ABSTRACT

A power distribution block is disclosed for supplying bussed power to a circuit board. The block uses, in combination, a known connector having therein a plurality of terminals each having one mating end and an oppositely directed conductor engaging portion. A plurality of bus bars, each having at least one tine extending from each of two ends, are each electrically and mechanically joined to at least one connector and to a circuit board. The assembly of connector and bus bars is enclosed in a housing shell serving to both separate rows of bus bars and support the connector on the circuit board.

5 Claims, 3 Drawing Figures

10
76
84
18
82
78
80
86
30
12
72
72
66
64
16
24
68
70
26
28
74
90
90
20

NARROW PROFILE POWER DISTRIBUTION BLOCK

The subject narrow profile power distribution block is intended for use on a circuit board or the like and provide an interconnect for bussing power of different levels to circuitry of the circuit board.

There is a continuing problem in dealing with circuit boards in the need to provide power thereto without utilizing a great deal of the real estate of the board. Heretofore the power bussing connectors have always required an undue amount of space both on the surface of the board and in the immediate surrounding area.

According to the present invention, therefore, a power distribution block of low narrow profile as defined above is characterized in that an electrical connector of known configuration having a housing with a mating face, a plurality of terminal pasages extending through the housing and opening on the mating face and also opening outwardly toward the rear portions, is provided with a like plurality of terminals mounted each in a respective one of said passages, each terminal having a mating portion directed towards the mating face and at least one slotted portion lying in the open rear portion. The power bussing feature is characterized by a plurality of bus bars each provided with a first end profiled for mating with at least one of the terminals and a second end extending normal to the first end and provided with means for engaging circuitry of the circuit board and a housing engaging the connector to enclose the bus bas separating the individual rows thereof.

An embodiment of the subject invention will now be described by way of example with reference to the accompanying drawings in which.

Figure 1:
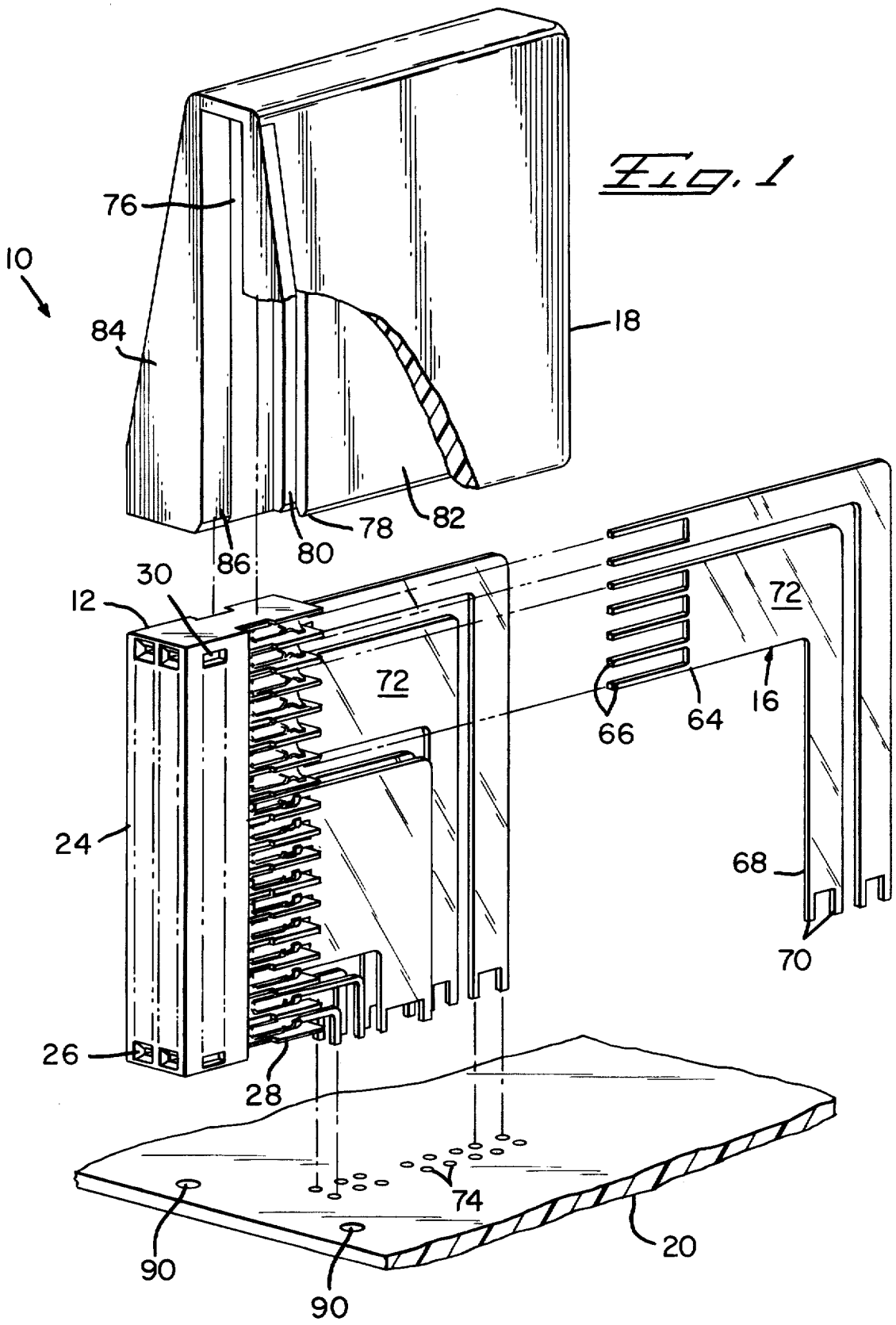
FIG. 1 is an exploded perspective view of a power distribution block according to the subject invention.
Figure 2:
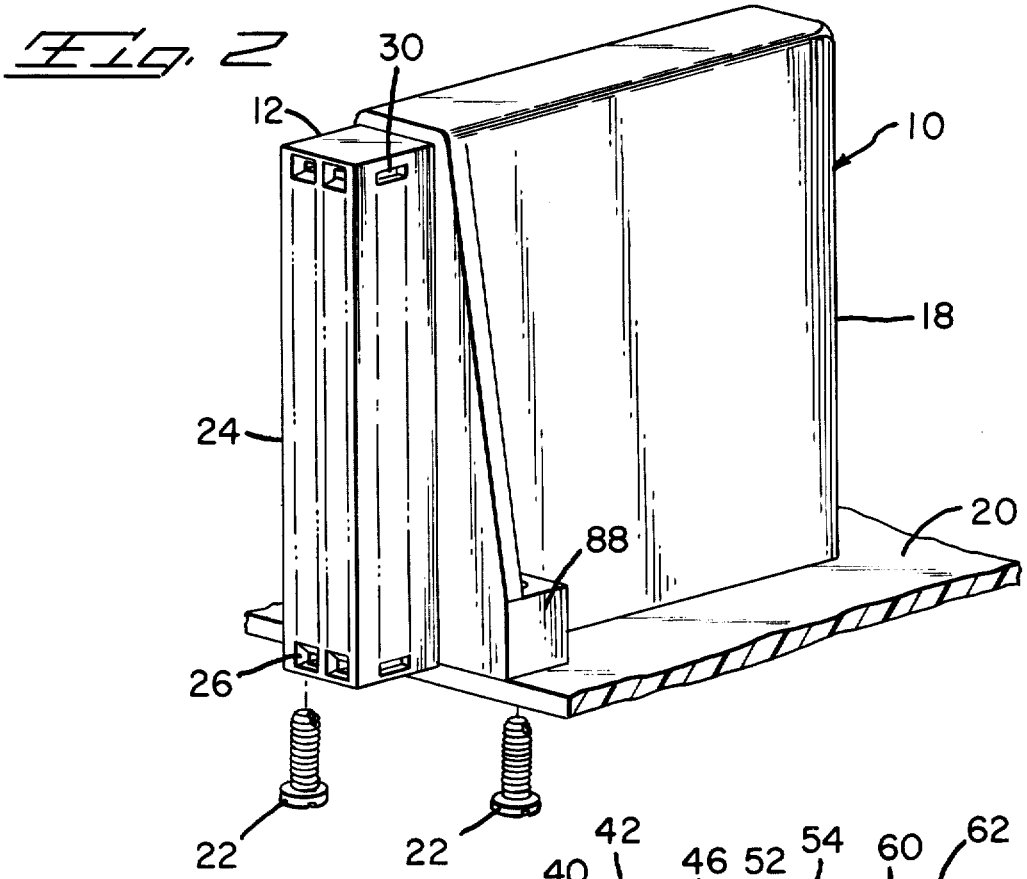
FIG. 2 is a perspective view of the power distribution block of FIG. 1 in a fully assembled condition.

The subject power bus connector 10 is formed by a connector housing 12, a plurality of terminals 14, a plurality of bussing members 16, and a closure housing 18. The subject power bus connector is adapted to be mounted on a circuit board 20 or the like by means of screws or the like 22.

The housing 12 is an elongated member of rigid plastics material having a mating face 24 with a plurality of terminal passages 26 opening therein in a pair of aligned rows. The sides of the housing are open at the rear so that the passages 26 are enclosed adjacent the mating face and are open channel-shaped at their rear ends 28. The housing is also provided with a plurality of apertures 30 each aligned with a respective passge and spaced rearwardly of the mating face 24.

Each terminal 14 includes a forwad mating end 32, here shown as a pin receptacle 34 of the type disclosed in U.S. Pat. No. 3,363,224, the disclosure of which is incorporated herein by reference. This receptacle 34 has an outwardly directing locking lance 36 and a rear closure or post stop 38 which serves to both limit penetration of a mating pin terminal (not shown) into the receptacle 34 as well as penetration of the bus bar 16 into the receptacle 34. The terminal 14 further includes a bus bar engaging rear portion 40 formed by a pair of upstanding walls 42, 44 defining a channel 46 therebetween. Each end of each wall has an inwardly directed end portion 48, 50, 52, 54 with the opposing pairs end portions defining conductor engaging slots therebetween. Each side wall 42, 44 is further provided with indents 56, 58 which provide strength to the sidewalls during the terminating operation. The terminal is completed by a pair of crimp ears 60, 62.

Each bus bar 16 has a first end 64 with at least one first tine 66 extending therefrom and a second end 68 with at least one second tine 70 extending therefrom. The various busses 16 each are formed with a body portion 72 having the first and second end at right angles in the plane thereof. The tines 66 on the first end 64 are spaced so as to be engaged in the channel 46 of rear portions 40 a respective terminal 14 while the second end 68 is profiled so that the tines 70 are received in the respective holes 74 in the circuit board 20 wherein they are secured and interconnected with circuitry thereof (not shown) by soldering in conventional fashion. Since the connector 12 is a dual row connector, the bus bars are likewise arranged in two spaced rows, each sized as necessary to distribute the required power. Those bus bars carrying higher power are larger in dimensions and have plural first tines 66 each connected to a respective terminal 14. Likewise, they have plural second tines 70 engaging plural holes 74 in the circuit board 20.

The housing shell 18 is formed of insulative material with a narrow overall profile and defining a central cavity 76 separated by an intermediate contact barrier 78 separating the cavity 76 into first and second parallel spaced chambers 80, 82. The shell 18 is also profiled at its forward end 84 to mate with the connector 12 and can include inwardly directed projections 86 making a locking engagement therewith. The forward end 84 is also profiled to have integral, transversely extending mounting blocks 88 which receive the mounting screws 22 through apertures 90 in the circuit boad 20.

Figure 3:
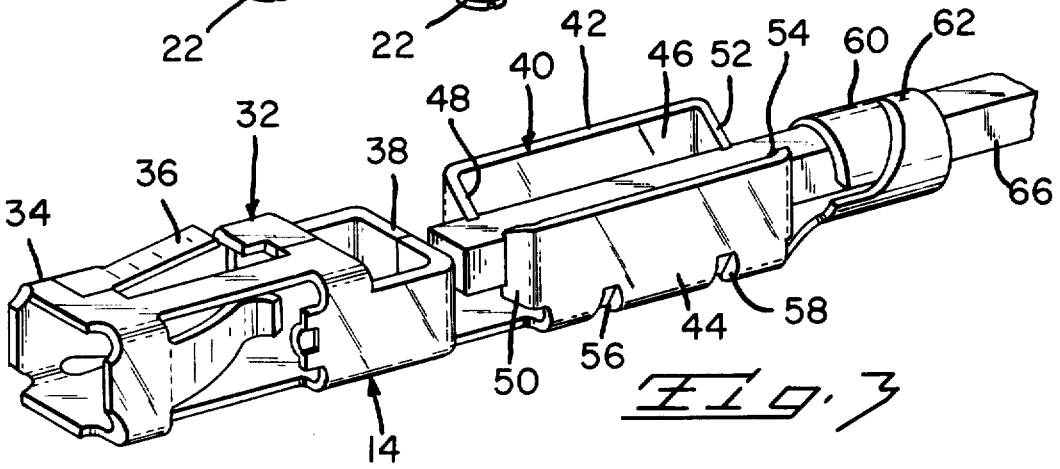
FIG. 3 is a perspective view, on an enlarged scale, of a terminal engaging a bussing bar according to the present invention.

The subject connector is assembled by first inserting the terminals 14 into the respective passages 26 of the connector housing 12 and then aligning and applying the respective bus bars 16. The tines 66 of the bus bars are inserted into the respective terminals so that the inturned ends 48, 50, 52, 54 make a cutting engagement with the bus bar tine 66 and the ears 60, 62 are crimped onto the tine 66 to assure good electrical and mechanical interconnection (as shown in FIG. 3). When all of the bus bars 16 have been applied to the terminals 14, the housing shell 18 is then slid over the connector 12 and the bus bars 16 with the barrier 78 extending between the rows of the bus bas. The entire assembly can then be joined to the circuit board 20 with the tines 70 being electrically and mechanically connected thereto by a standard soldering process and the entire assembly secured to the circuit board 20 by application of the screws 22.

We claim:

1. A narrow profile connector for bussing power to circuit boards and the like without utilizing any substantial amount of real estate on the circuit board, comprising:

a connector housing of rigid insulative material having a plurality of terminal passages extending from a rear end through said housing to open on a front mating face, each passage being fully enclosed at the mating face and open channel shaped at the rear end;

a plurality of terminals each mounted in a respective one of said passages, each said terminal having a forward mating end directd toward said front mating face and lying in the fully enclosed portion of said passage and a conductor engaging slotted rear portion lying exposed in said open channel shaped portion;

a plurality of bussing members each having first and second ends extending normal to each other in the plane of the respective bussing member, at least one tine extending from each said end, first tines on said first end being engageable with the slotted rear portion of said terminals to make electrical and mechanical contact therewith, second tines on said second end being engageable with circuitry of said circuit board, and a housing shell of rigid insulative material having a central cavity defined by spaced parallel walls, said shell being profiled to mate with said connector housing and to enclose said bus members, whereby said connector can be applied to an edge portion of a circuit board in an edgewise condition presenting a narrow profile while providing an adequate bussing for the necessary power.

2. A narrow profile connector according to claim 1 wherein:

said connector housing has an elongated profile; and said housing shell further includes means for mounting on said circuit board with said connector housing elongated profile extending normal to the circuit board.

3. A narrow profile connector according to claim 1 wherein:

said slotted rear portion of each said terminal comprises:

a channel shape formed by two upstanding, parallel, spaced sidewalls each having at least one inturned end defining a slot with the opposite inturned end, said first tine being piercingly received in said slots.

4. A narrow profile connector according to claim 3 wherein:

each said terminal further comprises a pair of integral crimp ears adapted to crimpingly secure a respective first tine in the slotted rear portion.

5. A narrow profile connector according to claim 1 wherein said terminals and said bus bars are in at least two rows, further comprising:

said housing shell defining at least two bus bar receiving chambers in said cavity with a barrier separating said chambers and the bus bars contained therein.

* * * * *